US008048534B2

(12) United States Patent
Gregory et al.

(10) Patent No.: US 8,048,534 B2
(45) Date of Patent: Nov. 1, 2011

(54) COMPOSITE USED FOR THERMAL SPRAY INSTRUMENTATION AND METHOD FOR MAKING THE SAME

(75) Inventors: Otto J. Gregory, Wakefield, RI (US); Markus A. Downey, Narragansett, RI (US)

(73) Assignee: Board of Governors for Higher Education, State of Rhode Island and Providence Plantations, Providence, RI (US)

( * ) Notice: Subject to any disclaimer, the term of this patent is extended or adjusted under 35 U.S.C. 154(b) by 0 days.

(21) Appl. No.: 12/683,796

(22) Filed: Jan. 7, 2010

(65) Prior Publication Data

US 2010/0116379 A1 May 13, 2010

Related U.S. Application Data

(63) Continuation of application No. 11/698,555, filed on Jan. 26, 2007, now abandoned, and a continuation of application No. 10/909,598, filed on Aug. 2, 2004, now abandoned.

(60) Provisional application No. 60/491,377, filed on Jul. 31, 2003.

(51) Int. Cl.
*B32B 15/04* (2006.01)
*C22F 1/00* (2006.01)
*B05D 3/02* (2006.01)

(52) U.S. Cl. ..... 428/629; 428/633; 428/678; 428/680; 148/527; 148/537; 427/350; 427/374.1; 427/383.7; 427/405; 427/419.3

(58) Field of Classification Search ..... None
See application file for complete search history.

(56) References Cited

U.S. PATENT DOCUMENTS 4,321,310 A 3/1982 Ulion et al.
4,321,311 A 3/1982 Strangman
4,401,697 A 8/1983 Strangman
4,405,659 A 9/1983 Strangman
4,405,660 A 9/1983 Ulion et al.
4,414,249 A 11/1983 Ulion et al.
4,439,248 A * 3/1984 Herchenroeder et al. .... 148/280
(Continued)

FOREIGN PATENT DOCUMENTS

DE 19842417 A1 * 3/2000

OTHER PUBLICATIONS

M.F.J. Koolloos and G. Marijnissen, "Burner rig Testing of "herring-bone" EB-PVD Thermal Barrier Coatings", National Aerospace Laboratory NLR, presented at the TurbOMat: International Symposium on Thermal Barrier Coatings and Titanium Aluminides, Bonn, Germany, Jun. 17-19, 2002, 13 pages.

(Continued)

*Primary Examiner* — John J Zimmerman
(74) *Attorney, Agent, or Firm* — Gesmer Updegrove LLP

(57) ABSTRACT

A superalloy article which comprises a substrate comprised of a superalloy, a bond coat comprised of MCrAlY wherein M is a metal selected from the group consisting of cobalt, nickel and mixtures thereof applied onto at least a portion of the substrate and a ceramic top coat applied over at least a portion of the bond coat. The bond coat is exposed to a temperature of within the range of between about 1600-1800° F. subsequent to its application onto the substrate.

19 Claims, 5 Drawing Sheets

U.S. PATENT DOCUMENTS

| | | | | |
|---|---|---|---|---|
| 4,880,614 | A | 11/1989 | Strangman et al. | |
| 4,916,022 | A | 4/1990 | Solfest et al. | |
| 5,015,502 | A | 5/1991 | Strangman et al. | |
| 5,627,637 | A | 5/1997 | Kapteyn | |
| 5,645,893 | A * | 7/1997 | Rickerby et al. | 427/405 |
| 5,667,663 | A * | 9/1997 | Rickerby et al. | 205/170 |
| 5,861,558 | A | 1/1999 | Buhl et al. | |
| 5,942,337 | A * | 8/1999 | Rickerby et al. | 428/623 |
| 6,071,627 | A | 6/2000 | Yasuda et al. | |
| 6,123,997 | A * | 9/2000 | Schaeffer et al. | 427/383.7 |
| 6,165,286 | A | 12/2000 | Bayer et al. | |
| 6,218,029 | B1 * | 4/2001 | Rickerby | 428/615 |
| 6,306,524 | B1 * | 10/2001 | Spitsberg et al. | 428/621 |
| 6,427,539 | B1 | 8/2002 | Chen et al. | |
| 6,447,854 | B1 | 9/2002 | Rigney et al. | |
| 6,482,469 | B1 | 11/2002 | Spitsberg et al. | |
| 6,482,537 | B1 | 11/2002 | Strangman et al. | |
| 6,521,966 | B1 | 2/2003 | Ishio et al. | |
| 6,607,789 | B1 | 8/2003 | Rigney et al. | |
| 2001/0031314 | A1 * | 10/2001 | Deus et al. | 427/295 |
| 2003/0039764 | A1 | 2/2003 | Burns et al. | |
| 2003/0170505 | A1 | 9/2003 | Okazaki et al. | |
| 2003/0203221 | A1 | 10/2003 | Spitsberg | |
| 2005/0003227 | A1 * | 1/2005 | Khan et al. | 428/632 |

OTHER PUBLICATIONS

Dyer et al, "Preparation and piezoresistive properties of reactively sputtered indium tin oxide thin films", Thin Solid Films 288, 1996, pp. 279-286.

Gregory et al, "An apparent n to p transition in reactively sputtered indium-tin-oxide high temperature strain gages", Thin Solid Films 405, 2002, pp. 263-269.

Gregory et al, "High temperature stability of indium tin oxide thin films", Thin Solid Films 406, 2002, pp. 286-293.

Gregory et al, "A self-compensated ceramic strain gage for use at elevated temperatures", Sensors and Actuators A 88, 2001, pp. 234-240.

NASA Aerospace Propulsion and Power Program NRA-01-GRC-02 Ceramic Strain Gages for Use at Temperatres up to 1500C Annual Technical Report, Dec. 2001-Oct. 2002, pp. 1-25.

Cahill et al., "Thermometry and Thermal Transport in Micro-Nanoscale Solid-State Devices and Structures", Journal of Heat Transfer, Apr. 2002, vol. 124, pp. 223-241.

Cahill et al., "Nanoscale thermal transport", Journal of Applied Physics, Jan. 15, 2003, vol. 93, No. 2, pp. 793-818.

* cited by examiner

COMPOSITE USED FOR THERMAL SPRAY INSTRUMENTATION AND METHOD FOR MAKING THE SAME

PRIORITY DATA

This application is a continuation of U.S. patent application Ser. No. 11/678,555, now abandoned, which was filed on Jan. 26, 2007 and is a continuation of U.S. patent application Ser. No. 10/909,598, now abandoned, which was filed on Aug. 2, 2004 and which claims priority to U.S. Provisional Patent Application No. 60/491,377 filed on Jul. 31, 2003 all of which are incorporated herein in their entirety.

GOVERNMENT RIGHTS

This invention was made with U.S. Government support under Contract No. NRA-01-GRC-02 from the National Aeronautic and Space Administration (NASA).

BACKGROUND OF THE INVENTION

1. Field of the Invention

This invention relates generally to sprayed instrumentation and in particular to composites used for thermal sprayed instrumentation.

2. Description of the Prior Art

As the gas temperature in turbine engines increases, improvements to existing thermal spray instrumentation are necessary to meet the challenges associated with monitoring the temperature and strain of the various engine components operating at temperatures in excess of 2200° F. (1200° C.). A thermal spray instrument can include wire instrumentation laid down within a thermal barrier coating having a bond coat and a top coat. The wire instrumentation can facilitate the measurement of direct strain and temperature inside an engine when coupled with a data acquisition system. In a typical engine test, the thermal spray instrumentation must survive at least 50 to 100 hours of thermal cycling so that sufficient data can be collected. The main failure mechanism in thermal spray instrumentation is decohesion/delamination at the top coat/bond coat interface due to oxidation of the bond coat and a mismatch in the thermal coefficient of expansion (TCE) between the top coat and the bond coat. Lei, J. F., "Protective Coats for High-Temperature Strain Gages", NASA Lewis, Tech Briefs, September 1993; Gregory, O. J., "Flame Spray Strain Gages with Improved Durability and Lifetimes", Annual Technical Report for NASA Aerospace and Power Program NRA-01-GRC-02, October 2002; Roesch, E., "Improved Strain Gage for High Temperature Test Engine Application" Eighth Hostile Environmental Conference, Dearborn, Mich., October 1995; Wachtman, J. B. et al., "Ceramic Films and Coatings", Noyes Publications, Westwood, N.J., 1993; Niska, H. et al., "Chemical Vapor Deposition of Alpha Aluminum Oxide for High Temperature Aerospace Sensors", Journal of Vacuum Science and Technology, 4 (2000), 1653-1659; and Trottier, C. M. et al., "Dielectric Stability of Native Oxides formed on NiCrAlY-Coated Substrates", Thin Solid Films, 24 (1992), 254-260.

A need exists, therefore, to improve fatigue life of the sprayed coatings used to imbed strain gages and thermocouples.

SUMMARY OF THE INVENTION

Broadly, the invention includes a composite comprising a bond coat of MCrAlY wherein M is a metal selected from the group consisting of cobalt, nickel, and mixtures thereof that is coated to a superalloy. The bond coat is subjected to a heat treatment in reduced oxygen partial pressures to selectively oxidize the bond coat to form a compositionally graded material. A ceramic top-coat is applied over at least a portion of the compositionally graded material. The composite can be used for thermal sprayed instrumentation or as a thermal barrier coating for engine parts of automobile engines, gas turbine engines and turbines for power generation.

In another aspect of the invention, the composite is comprised of a bond coat comprised of MCrAlY wherein M is a metal selected from the group consisting of cobalt, nickel and mixtures thereof that is coated to a superalloy. An oxygen diffusion barrier comprised of a noble metal is applied onto at least a portion of the bond coat and is heat treated to reduce the extent of internal oxidation in the bond coat. A ceramic top coat is applied over at least a portion of the heat treated diffusion barrier. The composites can be used for thermal sprayed instrumentation or as thermal barrier coatings for engine parts of automobile engines, gas turbine engines and turbines for power generation.

In yet another aspect, the invention includes a method for producing a superalloy article which comprises providing a substrate comprised of a superalloy, applying a bond coat comprised of MCrAlY wherein M is a metal selected from the group consisting of cobalt, nickel and mixtures thereof to at least a portion of the substrate to form a first composite, applying an intermediate layer comprised of a noble metal to at least a portion of the bond coat to form a second composite, heating the second composite to form a heat treated second composite, cooling the heat treated second composite to form a cooled second composite and applying a ceramic top coat over at least a portion of the cooled second composite to form the superalloy article.

In another aspect of the invention, the second composite is heated by exposing the first composite to a target temperature within the range of between about 1600-1800° F.

In yet another aspect of the invention, the first composite is exposed to the target temperature by: a) placing the second composite in a controlled ambient; b) raising the temperature of the controlled ambient at a predetermined rate for a first predetermined time period; c) maintaining the temperature of the controlled ambient for a second predetermined time period upon expiration of the first predetermined time period; d) repeating steps b) and c) until the temperature of the controlled ambient reaches the target temperature upon expiration of the first predetermined time period of step b); and e) maintaining the target temperature for the second predetermined time period.

In still another aspect, the invention includes a method for producing a superalloy article which comprises providing a superalloy substrate, applying a bond coat comprised of MCrAlY wherein M is a metal selected from the group consisting of cobalt, nickel and mixtures thereof to at least a portion of the substrate to form a composite, heating the first composite to form a heat treated composite, cooling the heat treated composite to form a cooled composite and applying a ceramic top coat over at least a portion of the cooled composite to form the superalloy article.

In yet another aspect of the invention, the composite is heated by exposing the composite to a target temperature within the range of between about 1600-1800° F.

In still another aspect of the invention, the composite is exposed to the target temperature by: a) placing the first composite in an ambient; b) raising the temperature of the ambient at a predetermined rate for a first predetermined time period; c) maintaining the temperature of the ambient for a second predetermined time upon expiration of the first predetermined time period; d) repeating steps b) and c) until the temperature of the ambient reaches the target temperature upon expiration of the first predetermined time period of step b); and e) maintaining the target temperature for the second predetermined time period.

These and other objects, features and advantages of the present invention will become more apparent in light of the following detailed description of the preferred embodiments thereof, as illustrated in the accompanying drawings.

DETAILED DESCRIPTION OF THE INVENTION

Figure 1:
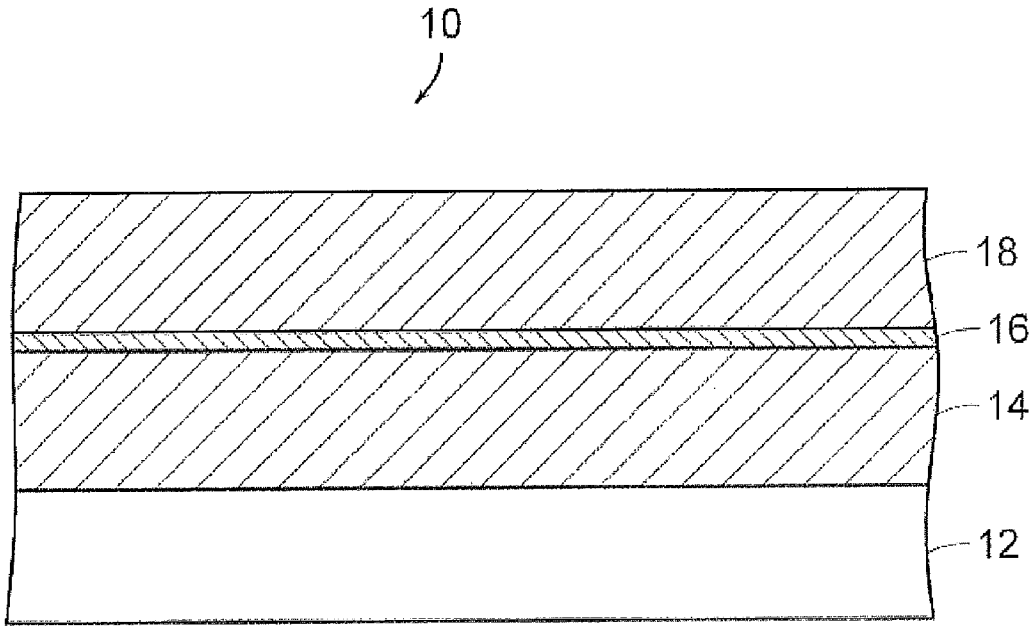
FIG. 1 is a sectional view of an embodiment of the invention.

With reference to FIG. 1, a sectional view of a superalloy article 10 is shown. A bond coat 14 comprised of MCrAlY wherein M is a metal selected from the group consisting of cobalt, nickel and mixtures thereof is coated onto at least a portion of a superalloy substrate 12. The superalloy substrate is comprised of nickel and cobalt based superalloys. Commercial examples of superalloys suitable for use in the invention include INCONEL 600, INCONEL 718, HASTALLOY X, RENE 41, MAR-M200, WASPALLOY A and UDIMET 700. The bond coat 14 can be coated onto the superalloy substrate 12 by thermal spraying, which includes flame spraying and plasma spraying, as well as electron beam evaporation to a thickness of within the range of between about 75 μm and 250 μm, preferably 100 μm.

An intermediate layer 16 comprised of a noble metal is applied onto at least a portion of the bond coat 14. The intermediate layer 16 functions as a diffusion barrier and is exposed to a series of ramped up temperatures in a controlled oxygen ambient subsequent to its application onto the bond coat 14 to reduce the extent of internal oxidation in the bond coat 14. The intermediate layer 16 can be comprised of noble metals selected from the group consisting of platinum, rhodium, palladium and iridium. The intermediate layer 16 can be applied onto at least a portion of the bond coat 14 to a thickness of within the range of between about 1 μm and 50 μm, preferably 5 μm, by sputtering, evaporation, or electroplating.

A ceramic top coat 18 is applied onto at least a portion of the heat treated intermediate layer 16. The ceramic top coat 18 can be applied onto the heat treated intermediate layer 16 to a thickness of within the range of between about 50 μm and 250 μm, preferably 100 μm, by thermal spraying, which can include flame spraying and plasma spraying, or electron beam evaporation. Suitable ceramics for use in the invention include alumina, magnesium aluminate spinel, zirconia, and stabilized zirconia.

In an alternative embodiment, the bond coat 14 can be heat treated by being exposing the bond coat 14 to a series of ramped temperatures in a controlled ambient subsequent to its application on the superalloy substrate 12. The intermediate layer 16 is applied onto the heat treated bond coat 14 and the ceramic top coat 18 is then applied over the intermediate layer 16. In this embodiment, the intermediate layer 16 is not heat treated.

Figure 2:
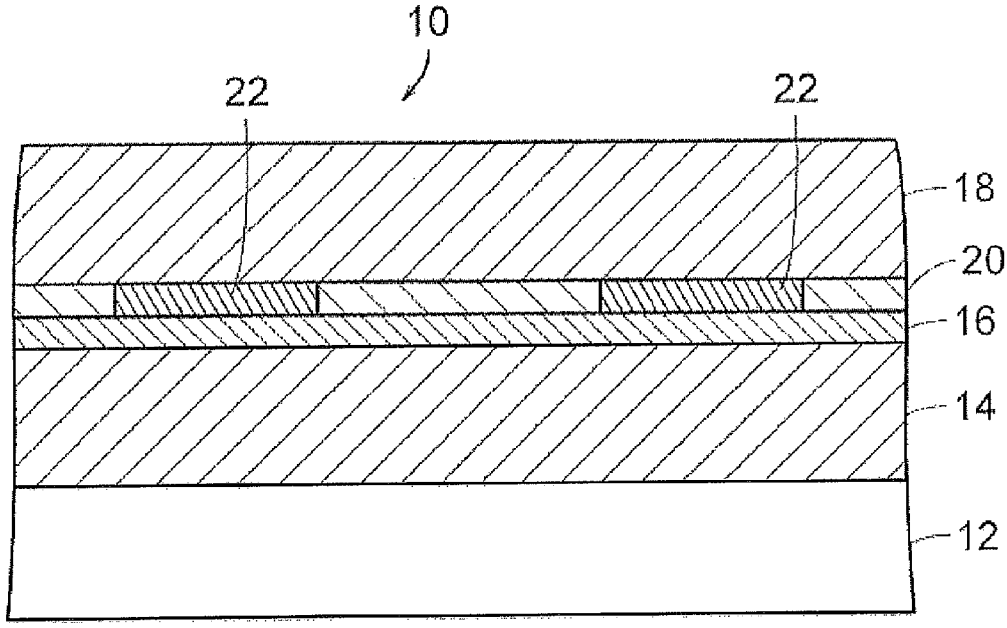
FIG. 2 is a sectional view of an alternative embodiment of FIG. 1.

With reference to FIG. 2, an alternative embodiment of FIG. 1 is shown. In this embodiment, instrumentation is embedded into the ceramic top coat 18 by thermal spraying a thin ceramic coating 20, e.g., 50 μm, onto at least a portion of the intermediate layer 16 and laying down wires 22 onto the ceramic coating 20. Subsequently, the ceramic top coat 18 can be thermally sprayed over the wires 22. The ceramic top coat 18 has a thickness that is greater than the thickness of the ceramic coating 20 and the wires can be comprised of any suitable metals or alloys, e.g., nickel chrome, platinum, tungsten/platinum or platinum/rhodium and may comprises Type R, Type S, Type K thermocouples. The coupling of the wires 22 to a data acquisition system (not shown) are well known in the art and therefore need not be discussed in detail.

Figure 3:
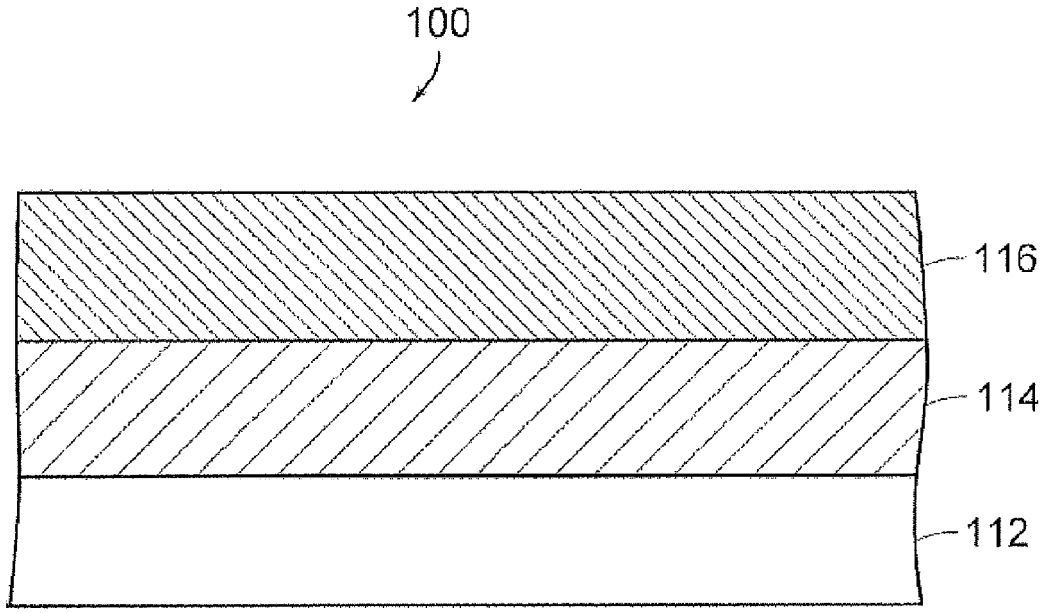
FIG. 3 is a sectional view of another embodiment of the invention.

With reference to FIG. 3, a sectional view of a superalloy article 100 is shown. A bond coat 114 comprised of MCrAlY wherein M is a metal selected from the group consisting of cobalt, nickel and mixtures thereof is coated onto at least a portion of a superalloy substrate 112. The superalloy substrate is comprised of nickel and cobalt based superalloys. Commercial examples of superalloys suitable for use in the invention include INCONEL 600, INCONEL 718, HASTALLOY X, RENE 41, MAR-M200, WASPALLOY A and UDIMET 700. The bond coat 114 can be coated onto the superalloy substrate 112 to a thickness of within the range of between about 75 μm and 250 μm, preferably 100 μm, by thermal spraying, which includes flame spraying and plasma spraying, as well as electron beam evaporation.

The bond coat 114 is exposed to a series of ramped temperatures in a controlled ambient subsequent to its application onto the superalloy substrate 110. A ceramic top coat 116 is then applied over at least a portion of the heat treated bond coat 112. The bond coat 114 is selectively oxidized when heated and thus a compositionally graded material is formed. The ceramic top coat 118 can be applied onto the heat treated bond coat 114 to a thickness of within the range of between about 50 μm and 250 μm, preferably 100 μm, by thermal spraying, which can include flame spraying and plasma spraying, or electron beam evaporation. Suitable ceramics for use in the invention include alumina, magnesium aluminate spinel, zirconia, and stabilized zirconia.

Figure 4:
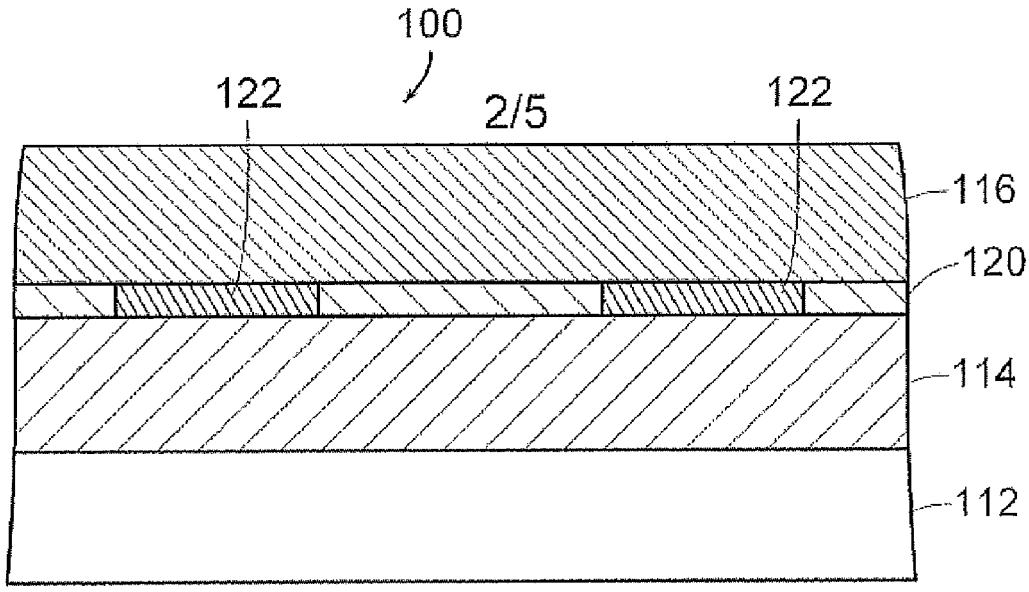
FIG. 4 is a sectional view of an alternative embodiment of FIG. 3.

With reference to FIG. 4, an alternative embodiment of FIG. 3 is shown. In this embodiment, instrumentation is embedded into the ceramic top coat 116 by thermal spraying a thin ceramic coating 120, e.g., 50 μm, onto at least a portion of the bond coat 114 and laying down wires 122 onto the ceramic coating 120. Subsequently, the ceramic top coat 116 can be applied over the wires 122 by thermal spraying. The ceramic top coat 116 has a thickness that is greater than the thickness of the ceramic coating 120 and the wires 122 can be comprised of any suitable metal or alloy, e.g., nickel chrome, platinum, tungsten/platinum or platinum/rhodium and may comprise Type R, Type S, Type K thermocouples. The coupling of the wires 22 to a data acquisition system (not shown) are well known in the art and therefore need not be discussed in detail.

Substrates

Inconel 718 coupons, measuring ⅛ in thick, 3 inches long by 1 inches wide were used for all fatigue tests. Inconel 718 coupons are comprised of approximately 53% Ni, 18.5% Fe, 18.6% Cr, 3.1% Mo, 0.4% Al, 0.9% Ti, 0.2% Mn, 0.5% Si, 0.04% C, and 5% Nb. After grit blasting, a coating of either PRAXAIR N171 or PRAXAIR N343 was thermally sprayed onto the INCONEL 718 coupons with a thickness of 0.002-0.004 inches. Ceramic top coats used for the fatigue tests consisted of magnesium aluminate spinel (MgAl203) (St. Gobain, Northboro Mass.) or pure alumina (Al203) (St Gobain, Northboro Mass.) flame sprayed to a thickness of 0.013-0.018 inches.

Thermal Fatigue Testing

Figure 5:
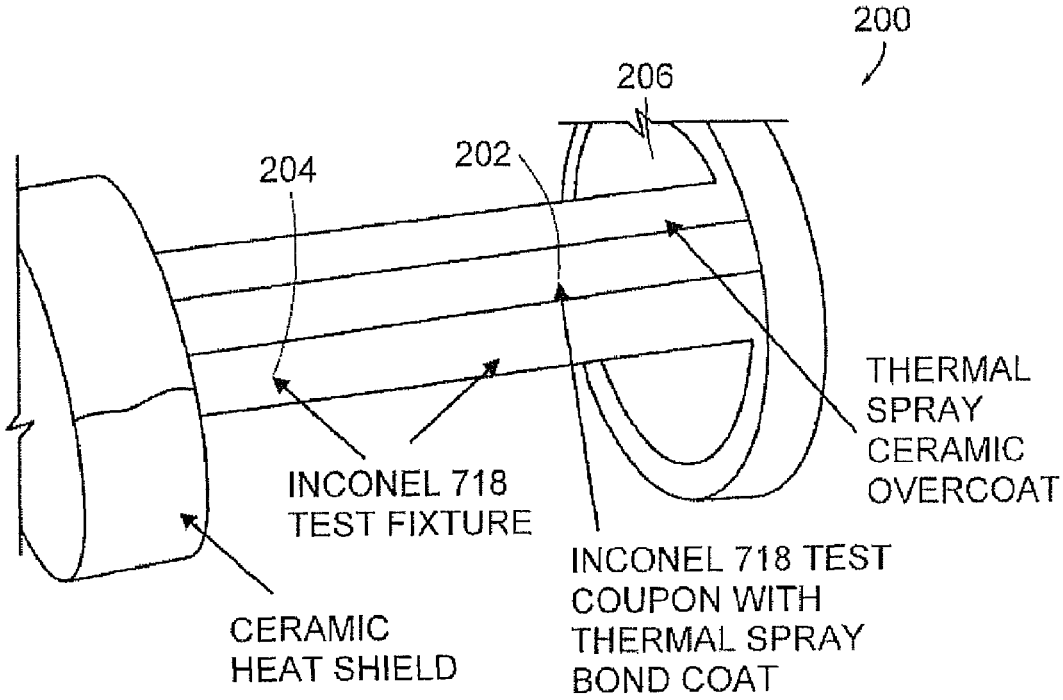
FIG. 5 is an illustration showing the apparatus used to thermal fatigue test the composites of the invention.

With reference to FIG. 5, fatigue testing was carried out in a DELTECH horizontal tube furnace 200. The test coupons 202 were fixed to an INCONEL 718 rig 204 that fit inside a furnace tube 206. The samples were heated to 1100° C. and held at this temperature for one hour. The rig 204 was then retracted from the tube and the coupon 202 was allowed to cool to 150° C. The cooling process took approximately 5-6 minutes. Upon reaching 150° C., the rig 204 with the coupon 202 was placed back in the furnace tube 206 and heated to 1150° C. again. The entire heating and cooling sequence was considered one cycle and the fatigue life of the samples was assessed based on the number of cycles to failure.

Heat Treatment of Bond Coats

Figure 6:
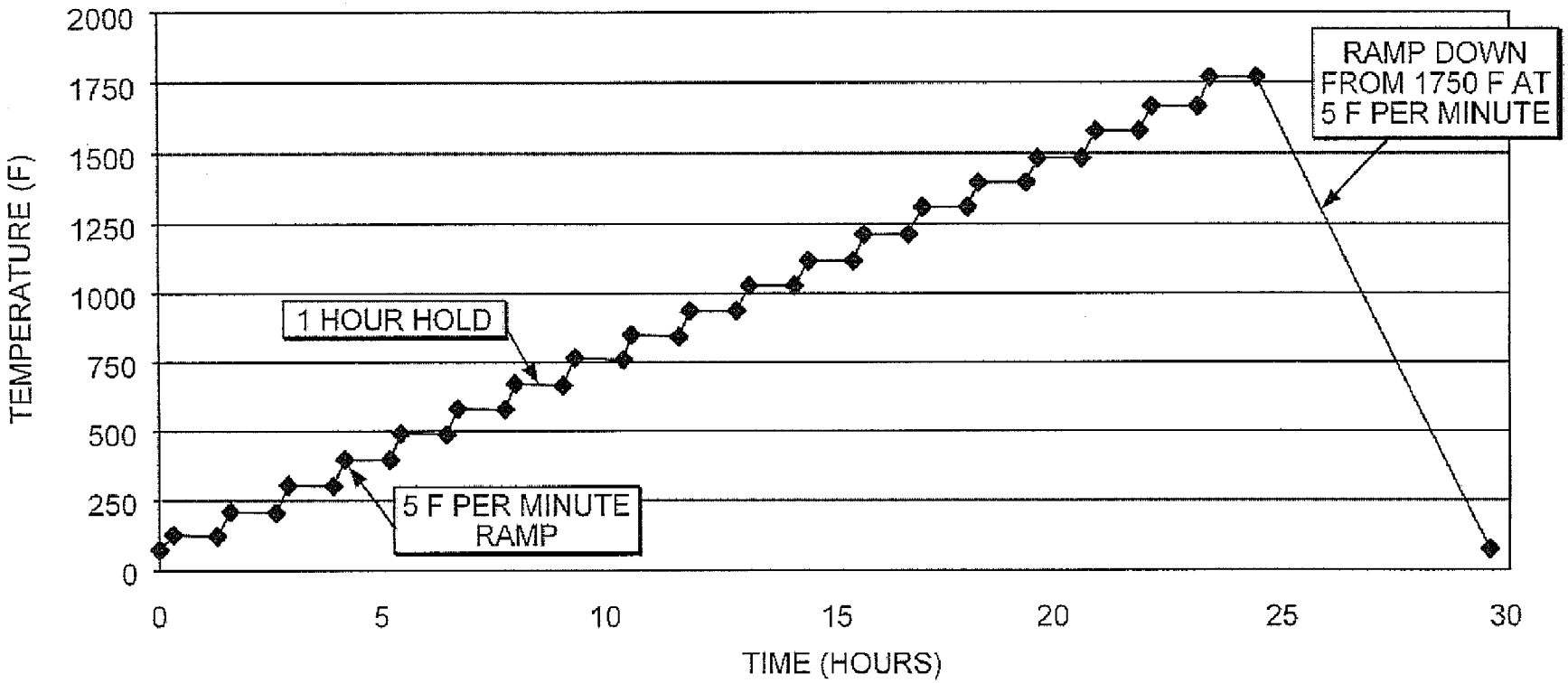
FIG. 6 is a graph showing the heat treatment schedule for the bond coats of the composites of the invention.

Heat treatment of the various bond coats, which included a NiCoCrAlY bond coat (Praxair 171) and a NiCrAlY bond coat (Praxair 343), was carried out in a DELTECH horizontal tube furnace. The tube furnace was sealed after the bond-coated INCONEL 718 coupons were placed inside and the tube was continuously purged with dry nitrogen gas. The nitrogen gas was passed through a NESLAB constant temperature bath, which cooled the incoming gas to −40° C. to remove any residual water. The ambient inside the tube comprised oxygen at a reduced partial pressure within the range of between about 100 ppm and 5,000 ppm, e.g., 1000 ppm. The temperature of the furnace was ramped for 20-minutes at a rate of 3° C. per minute and a one-hour hold until the desired temperature was reached. The final heat treatment temperature was between 1600-1800° F. (871-982° C.). The samples were then allowed to cool to room temperature. The heat treatment schedule is shown in FIG. 6. The fatigue life of the various bond coats including PRAXAIR 171 and PRAXAIR 343 coatings are set forth in table 1 below.

TABLE 1

Surface treatments, heat treatments and fatigue life of Inconel 718 test coupons with various bond coats.

| Bond Coat | | Thickness (inches) | Surface Treatment | Heat Treatment (F.) | Fatigue Life (Cycles to Failure) |
|---|---|---|---|---|---|
| Praxair | NiCoCrAlY | 0.002 | none | none | 52 |
| N171 | NiCoCrAlY | 0.003 | none | none | 55 |
| | NiCoCrAlY | 0.003 | none | none | 71 |
| | NiCoCrAlY | 0.002 | none | 1750 | 79 |
| | NiCoCrAlY | 0.035 | none | 1750 | 99 |
| | NiCoCrAlY | 0.003 | none | 1750 | 124 |
| | NiCoCrAlY | 0.003-.004 | none | 1750 | 144 |
| | NiCoCrAlY | 0.002 | Pt | 1750 | 81 |
| | NiCoCrAlY | 0.002 | Pt | 1800 | 192 |
| | NiCoCrAlY | 0.002 | Pt | 1750 | 124 |
| Praxair | NiCrAlY | 0.002 | none | none | 2 |
| N343 | NiCrAlY | 0.002 | none | 1750 | 2 |
| | NiCrAlY | 0.003 | none | 1750 | 25 |
| | NiCrAlY | 0.002 | Pt | 1600 | 2 |
| | NiCrAlY | 0.002 | Pt | 1750 | 1 |
| | NiCrAlY | 0.002 | Pt | 1750 | 7 |
| | NiCrAlY | 0.002 | Pt | 1800 | 6 |

As-sprayed PRAXAIR N171 and N343 bond-coated samples were fatigue tested to provide a baseline for comparison purposes, so the relative merits of the various surface treatments and heat treatments could be evaluated. It was determined that the heat treatment of the PRAXAIR 171 bond coats in reduced oxygen partial pressure yielded a significant increase in the fatigue life of the thermal sprayed INCONEL 718 coupons, as shown in Table 1. Samples heat-treated to 1750° F. (954° C.) in reduced oxygen partial pressure more than doubled fatigue life (110 cycles to failure vs. 52 cycles to failure for the as-sprayed material). This considerable increase in fatigue life can be attributed to the fact that selective oxidation of the aluminum and chromium in the bond coat yielded a graded interface and the TCE of the metallic bond coat and ceramic top coat was more closely matched as a result. This reduced the stress at the top coat/bond coat interface and permitted longer fatigue life. Heat treatment of the Praxair N343 bond coated samples yielded little or increase in the fatigue life of the samples, lasting only 2-3 cycles to failure, independent of heat treatment temperature.

The PRAXAIR N171 and N343 bond coated samples failed by different failure mechanisms. The PRAXAIR N171 bond coated samples failed by decohesion/delamination at the top coat-bond coat interface. The PRAXAIR N343 bond coated samples on the other hand failed by cohesive failure in the bond coat.

Platinum and Rhodium Diffusion Barrier Coatings

Figure 7:
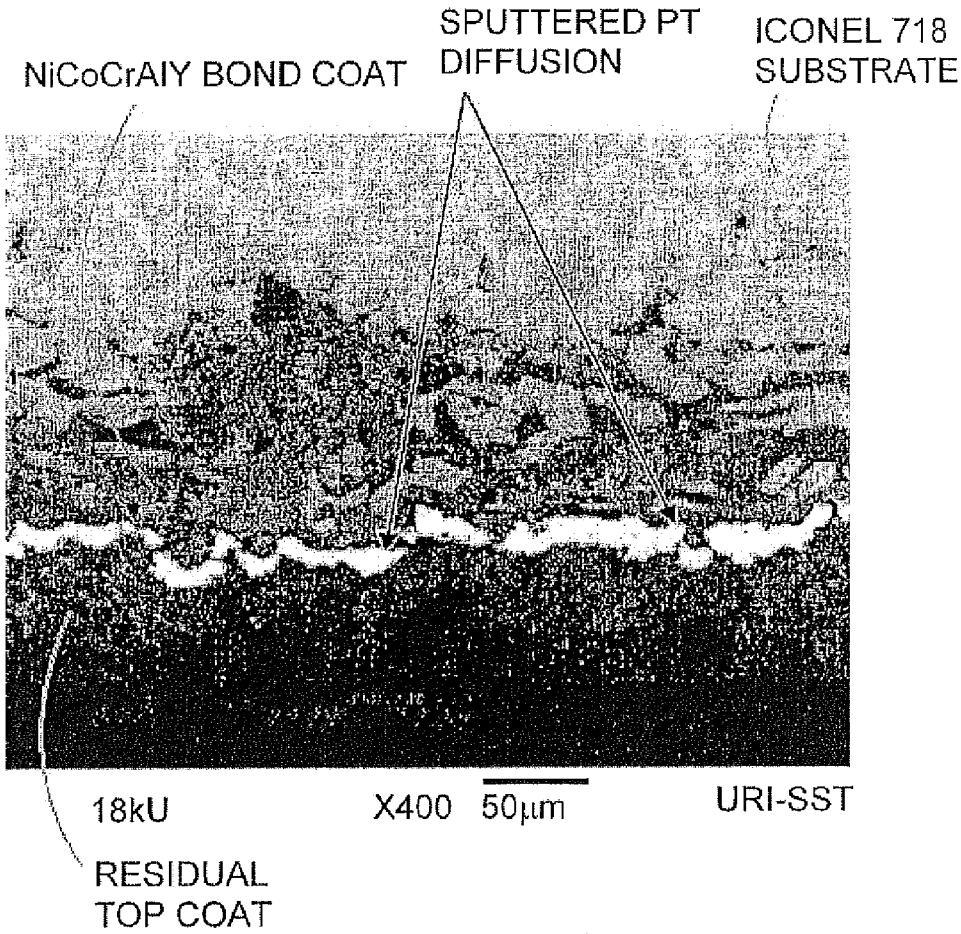
FIG. 7 is an SEM micrograph depicting an embodiment of the invention.

In an effort to reduce the extent of internal oxidation in the thermal sprayed bond coat, platinum and rhodium coatings were employed as diffusion barriers. Initially, 2 um thick coatings of platinum were deposited onto an as-sprayed PRAXAIR 171 bond coated coupons by physical vapor deposition (PVD). The platinum diffusion barrier can be seen in FIG. 7 and is evident in the micrograph as a white band running along the top coat/bond coat interface. The platinum coated INCONEL 718 coupons were then heat treated to 1800° F. (982° C.) as described in the above section entitled "Heat Treatment of Bond Coats". A magnesium aluminate spinel top coat (St Gobain, Northboro Mass.) was then thermally sprayed over the entire surface. Rhodium diffusion barriers were also applied to the surfaces of PRAXAIR 171 bond coated coupons by pen plating (electroplating). After pen plating, the PRAXAIR 171 bond coated INCONEL 718 coupons with 10 μm of rhodium, were heat-treated in reduced oxygen partial pressure and thermally sprayed with a ceramic top coat.

Platinum diffusion barriers applied by PVD in conjunction with reduced oxygen partial pressure heat treatment yielded a four fold increase in the fatigue life (192 cycles to failure vs. 52 cycles to failure for the as-sprayed material). The sputtered platinum films were thick enough to form an oxygen diffusion barrier and slowed the growth of internal oxides in the PRAXAIR 171 bond coat by promoting the formation of an alumina rich scale at the top coat/bond coat interface. The pen-plated rhodium coatings also showed some improvement in the fatigue life of the PRAXAIR 171 coupons. The platinum diffusion barriers applied by PVD to the PRAXAIR N343 bond coated samples showed little improvement in the fatigue life of the PRAXAIR N343 bond coated samples (7 cycles vs. 2-3 cycles to failure for the as-sprayed material).

All journal articles and reference citations provided above, in parentheses or otherwise, whether previously stated or not, are incorporated herein by reference.

Although the present invention has been shown and described with a preferred embodiment thereof, various changes, omissions and additions to the form and detail thereof, may be made therein, without departing from the spirit and scope of the invention.

What is claimed is:

1. A method for producing a superalloy article which comprises:

providing a superalloy substrate;

applying a bond coat comprised of MCrAlY wherein M is a metal selected from the group consisting of cobalt, nickel and mixtures thereof to at least a portion of said substrate to form a first composite;

applying an intermediate layer comprised of a noble metal to at least a portion of said bond coat to form a second composite;

heating said second composite to a target temperature within the range of about 1600° F.-1800° F. to form a heat treated second composite, wherein an oxygen partial pressure during the heating step was in a range of between about 100 ppm and 5,000 ppm;

cooling said heat treated second composite to form a cooled second composite; and applying a ceramic top coat over at least a portion of said cooled second composite to form the article.

2. The method of claim 1 wherein exposing said second composite comprises:

a) placing said second composite in a controlled ambient;

b) raising the temperature of said controlled ambient at a predetermined rate for a first predetermined time period;

c) maintaining the temperature of said controlled ambient for a second predetermined time upon expiration of said first predetermined time period;

d) repeating steps b) and c) until the temperature of said controlled ambient reaches said target temperature upon expiration of said first predetermined time period of step b); and e) maintaining said target temperature for said second predetermined time period.

3. The method of claim 2 wherein said intermediate layer comprises platinum.

4. The method of claim 3 wherein said predetermined rate comprises 3° C. per minute.

5. The method of claim 4 wherein said first predetermined time period comprises about 20 minutes.

6. The method of claim 5 wherein said second predetermined time period comprises about 60 minutes.

7. The method of claim 6 wherein said predetermined rate comprises a first predetermined rate and cooling said heat treated second composite comprises:

lowering said target temperature to a predetermined temperature at a second predetermined rate.

8. The method of claim 7 wherein said second predetermined rate comprises 3° C. per minute and said predetermined temperature is about 72° F.

9. A method for producing a superalloy article which comprises:

providing a substrate comprised of a superalloy;

applying a bond coat comprised of MCrAlY wherein M is a metal selected from the group consisting of cobalt, nickel and mixtures thereof to at least a portion of the said substrate to form a composite;

heating said composite in an atmosphere that includes nitrogen and includes between about 100 ppm and 5,000 ppm partial pressure of oxygen such that selective oxidation of aluminum and chromium in the bond coat yields a graded thermal coefficient of expansion of a thus formed heat treated composite;

cooling said heat treated composite to form a cooled composite and applying a ceramic top coat over at least a portion of said cooled composite to form the article.

10. The method of claim 9 wherein heating said composite comprises:

exposing said composite to a target temperature within the range of between about 1600-1800° F.

11. The method of claim 10 wherein exposing said composite comprises:

a) placing said first composite in an ambient;

b) raising the temperature of the ambient at a predetermined rate for a first predetermined time period;

c) maintaining the temperature of the ambient for a second predetermined time upon expiration of said first predetermined time period;

d) repeating steps b) and c) until the temperature of the ambient reaches said target temperature upon expiration of said first predetermined time period of step b); and e) maintaining said target temperature for said second predetermined time period.

12. The method of claim 11 wherein said predetermined rate comprises 3° C. per minute.

13. The method of claim 12 wherein said first predetermined time period comprises about 20 minutes.

14. The method of claim 13 wherein said second predetermined time period comprises about 60 minutes.

15. The method of claim 14 wherein said predetermined rate comprises a first predetermined rate and cooling said heat treated composite comprises:

lowering said target temperature to a predetermined temperature at a second predetermined rate.

16. The method of claim 15 wherein said second predetermined rate comprises 3° C. per minute and said predetermined temperature is about 72° F.

17. A superalloy article which comprises:

a substrate comprised of a superalloy;

a bond coat comprised of MCrAlY wherein M is a metal selected from the group consisting of cobalt, nickel and mixtures thereof applied onto at least a portion of the said substrate, said bond coat being exposed in an atmosphere having a reduced partial pressure of oxygen of between about 100 ppm and 5,000 ppm to a temperature of within the range of between about 1600-1800° F. subsequent to its application onto said substrate such that selective oxidation of aluminum and chromium in the bond coat yields a graded region having a graded thermal coefficient of expansion of the bond coat, said graded region including an interface surface; and a ceramic top coat applied to the interface surface of said bond coat, wherein said interface surface includes a thermal coefficient of expansion that is similar to a thermal coefficient of expansion of said ceramic top coat.

18. A superalloy article of claim 17 which further comprises:

an intermediate layer comprised of a noble metal applied onto at least a portion of said bond coat.

19. The superalloy article of claim 18 wherein M is a mixture of nickel and cobalt and the alloy article exhibits a fatigue life of at least 81 cycles to failure, wherein a cycle includes an entire heating and cooling sequence.

* * * * *